United States Patent [19]

Panicker et al.

[11] 4,423,984

[45] Jan. 3, 1984

[54] MARINE COMPLIANT RISER SYSTEM

[75] Inventors: Narayana N. Panicker, Grand Prairie, Tex.; Larry L. Gentry, Sunnyvale; Herbert H. Moss, Cupertino, both of Calif.

[73] Assignee: Mobil Oil Corporation, New York, N.Y.

[21] Appl. No.: 507,907

[22] Filed: Jun. 27, 1983

Related U.S. Application Data

[63] Continuation of Ser. No. 220,890, Dec. 19, 1980, abandoned.

[51] Int. Cl.[3] ..... E21B 43/01

[52] U.S. Cl. ..... 405/195; 166/344

[58] Field of Search ..... 405/169, 195; 166/339, 166/344, 345, 350, 359, 366, 367

[56] References Cited

U.S. PATENT DOCUMENTS

| | | | |
|---|---|---|---|
| 3,372,745 | 3/1968 | Holmes | 166/368 |
| 3,556,208 | 1/1971 | Dean . | |
| 3,586,103 | 6/1971 | Brown et al. . | |
| 3,589,441 | 6/1971 | Brown et al. | 166/339 |
| 3,911,688 | 10/1975 | Behar | 166/350 |
| 4,098,333 | 7/1978 | Wells et al. . | |
| 4,102,146 | 7/1978 | Dietrich | 405/169 |
| 4,182,584 | 1/1980 | Panicker et al. | 405/195 |
| 4,191,256 | 3/1980 | Croy et al. | 166/344 X |

FOREIGN PATENT DOCUMENTS

| | | | |
|---|---|---|---|
| 2370219 | 11/1976 | France | 166/366 |

OTHER PUBLICATIONS

Oil & Gas Journal, Behar et al., Oct. 2, 1978, pp. 111–125.

*Primary Examiner*—David H. Corbin

*Attorney, Agent, or Firm*—A. J. McKillop; M. G. Gilman; J. F. Powers, Jr.

[57] ABSTRACT

A marine compliant riser system is provided for attaching a flexible flowline to a buoyed conduit riser section. The improved system includes a yoke assembly for receiving flexible flowline with a means for retaining a terminal portion of the flexible flowline at a substantially normal catenary departure angle. Support means are mounted at the top of the buoyed section, and gooseneck connection means mounted on the support means for establishing fluid communication between the flexible flowline and conduit in the buoyed riser section.

An installation method is disclosed for completing the improved riser system in deepwater.

3 Claims, 22 Drawing Figures

FIG. 6
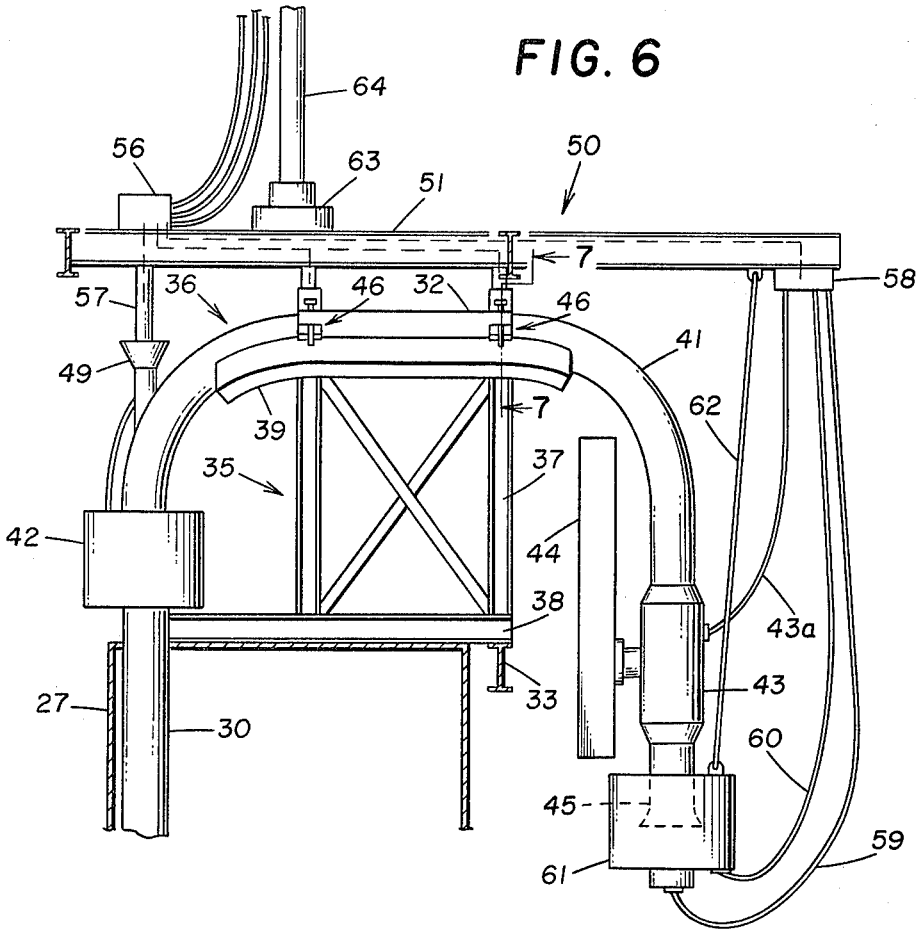
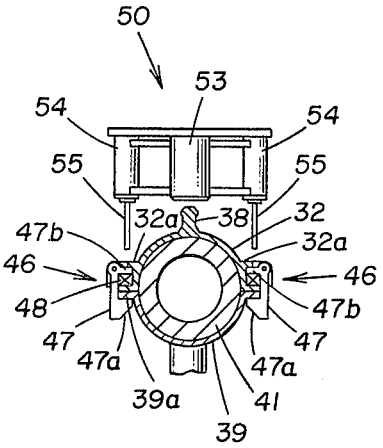
FIG. 7

MARINE COMPLIANT RISER SYSTEM

This is a continuation of copending application Ser. No. 220,890, filed Dec. 19, 1980, now abandoned.

BACKGROUND OF THE INVENTION

The present invention relates to a marine riser system and method of installation. In particular, it relates to a method and apparatus for providing flexible flowlines between a submerged fixed-position riser section for connecting a surface facility to a subsea well head or manifold system.

A critical consideration in the production of fluid hydrocarbons from marine deposits lies in providing a fluid communication system from the marine bottom to the surface after production has been established. Such a system, commonly called a production riser, usually includes multiple conduits through which various produced fluids are transported to and from the surface, including oil and gas production lines, service, electrical and hydraulic control lines.

For offshore production, a floating facility can be used as a production and/or storage platform. Since the facility is constantly exposed to surface and sub-surface conditions, it undergoes a variety of movements. In such a zone of turbulence, heave, roll, pitch, drift, etc., may be caused by surface and near surface conditions. In order for a production riser system to function adequately with such a facility, it must be sufficiently compliant to compensate for such movements over long periods of operation without failure.

One example of such a marine riser is the compliant riser system disclosed in U.S. Pat. No. 4,182,584. This compliant riser system includes (1) a vertically rigid section which extends from the marine bottom to a fixed position below the zone of turbulence that exists near the surface of the water, and (2) a flexible section which is comprised of flexible flowlines that extend from the top of the rigid section, through the turbulent zone, to a floating vessel on the surface. A submerged buoy is attached to the top of the rigid section to maintain the rigid section in a substantially vertical position within the water. With riser systems of this type difficulties often arise in installing and maintaining the flexible conduits. Often the flexible flowline is attached to a rigid section such that the end portion adjacent the fixed or rigid portion is not attached at a normal catenary departure angle. This can result in localized stresses, causing undue wear in the flexible flowline at its terminal hardware. If a natural catenary shape is assumed by the flowline, it approaches the fixed position section pointed upwardly, nearly vertical at its point of suspension.

It is an object of this invention to provide a compliant riser system in which the flexible section assumes a substantially vertical departure angle at its terminal portion, whereby the flexible section conduits are supported longitudinally with relatively low transverse force vectors.

SUMMARY OF THE INVENTION

An improved marine compliant riser system is provided for connecting a marine floor base to a surface facility. This system includes a fixed position vertical conduit section comprising a plurality of rigid flowlines extending from the marine floor base to a submerged buoy section located beneath the marine surface. A flexible conduit section comprising a plurality of flexible caternary flowlines is operatively connected in fluid communication between the buoy section and surface facility, the flexible conduits terminating in a substantially vertical catenary departure angle adjacent the buoy section. In order to support the weight of the flowlines on the buoy section during connection and disconnection, a yoke assembly may be releasably mounted on the buoy section to provide terminal support means for the flexible conduits. Yoke locking means receive the flexible conduits in spaced relationship. Supported in predetermined positions between the yoke assembly and buoy sections are a plurality of inverted U-shaped connection assemblies (hereafter sometimes called gooseneck connections), which provide means for operatively connecting the flexible conduits to corresponding flowlines in the fixed vertical conduit section.

In a typical riser system according to this invention, the U-shaped configuration means may be inserted into respective connectors at the yoke assembly and may have hydraulically actuated connectors for operatively connecting the U-shaped connection means to corresponding flowlines at the buoy section. Preferably, the buoy section includes rigid conduit support structures mounted on the buoy section and each having an upper trough for receiving a corresponding inverted U-shaped connector for assembly. These support structures are adapted to receive and support the U-shaped connection assembly during installation and fluid connection.

In another aspect, the invention encompasses a method for installing a marine compliant riser system in deep water. The installation technique includes affixing a buoyed multi-conduit riser section to the marine floor base for connection to a source of hydrocarbon fluid with the riser section terminating at a buoy section at a submerged, fixed location. These riser conduits are upwardly disposed to receive a corresponding connector, and may be provided with casing-mounted buoy means. A flexible flowline bundle is assembled with parallel flexible conduits and one end is connected to a surface facility, such as a production vessel or the like. A substantially unhindered catenary configuration is obtained by spreading and retaining the flexible flow line bundle in spaced parallel relationship while permitting longitudinal movement of the individual flowlines, hydraulic supply and electrical umbilicals. A yoke assembly is attached at a lower end of the flexible flow line bundle to the buoy section for supporting the flexible flow line bundle in catenary arrangement with the flexible conduits being disposed for pendant and connection. After lowering and aligning individual gooseneck connectors onto corresponding connector supports on the buoy section, with the gooseneck connectors being vertically aligned for fluid connection with respective flexible conduits on the yoke assembly and rigid conduits at the buoyed casing, the flexible conduits are connected through the gooseneck connectors to respective rigid conduits to establish fluid communication through the compliant riser system.

The apparatus and installation methods are particularly advantageous in providing multiple flowline compliant risers which are individually supported in a relatively unstressed position. These and other advantages and features will be seen in the following drawing and description of preferred embodiments.

THE DRAWING

FIG. 6 is a detailed side view, partially in vertical cross-section, showing an inverted U-shaped connection assembly according to the present invention;

FIG. 7 is a partial vertical cross-section view along lines 7—7 of FIG. 6, showing connector and support elements;

DESCRIPTION OF THE PREFERRED EMBODIMENTS

In the following explanation of the invention concept, certain portions of the overall compliant riser system are shown by example merely to illustrate a typical operative embodiment. However, modifications and variations can be made within the scope of the invention. For instance, the surface facility need not be a production vessel, semi-submersible units or floating platforms being viable alternative structures for use with compliant risers, as shown in U.S. Pat. No. 4,098,333. Likewise, the specific structure of the marine bottom connection may be adapted for single well heads, multi-well gathering and production systems and/or manifolds for receiving and handling oil and gas. Submerged, free-standing lower riser sections need not be rigid conduits, since buoy-tensioned flexible tubing or hoses can be maintained in fixed position when attached to the ocean floor, as shown in U.S. Pat. No. 3,911,688 and French Pat. No. 2,370,219 (Coflexip). Limited excursions of the lower riser section is permissible, but the catenary upper section is relied upon to permit significant horizontal excursions and elevational changes in the surface facility.

Figure 1:
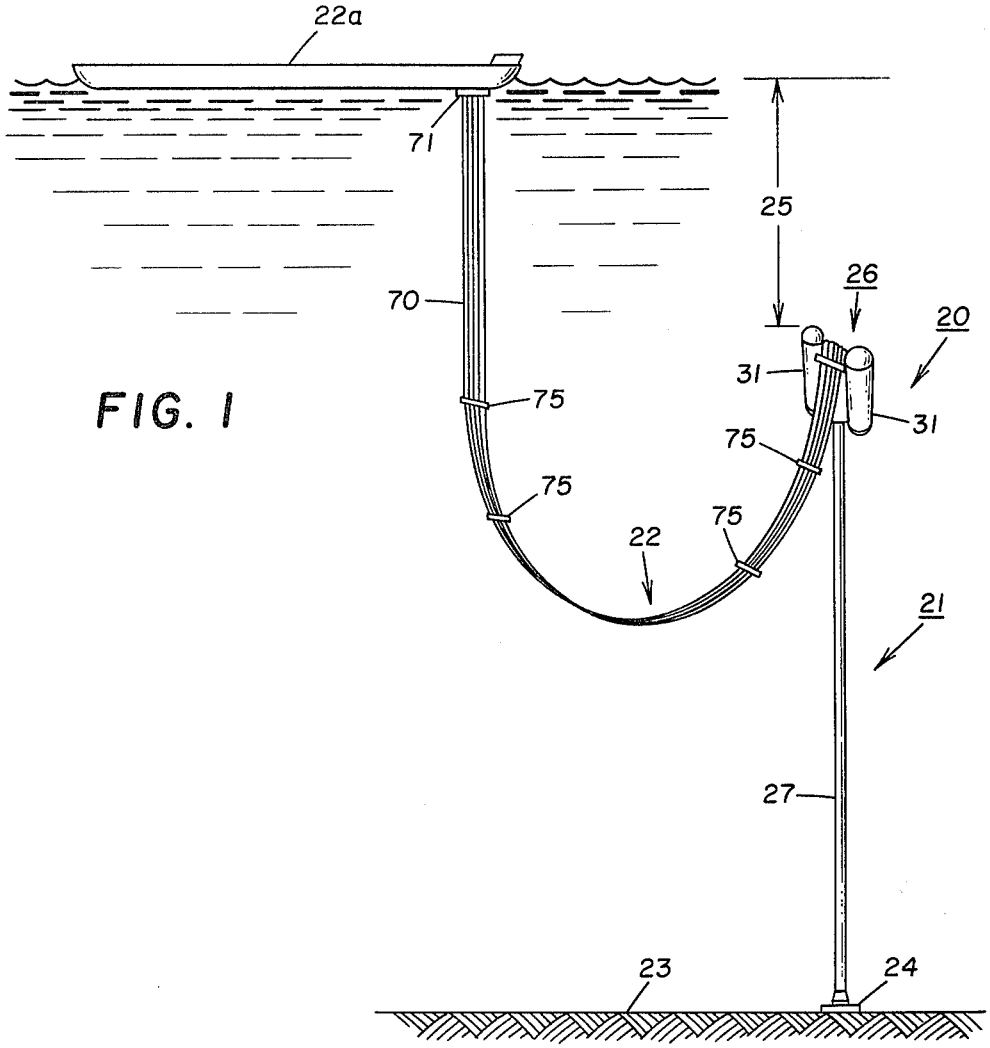
FIG. 1 is a schematic representation of a marine riser system, with a side view of a floating vessel and subsea components.

Referring now to the drawings, FIG. 1 discloses marine compliant riser system 20 in an operational position at an offshore location. Riser system 20 has a lower rigid section 21 and an upper flexible section 22. Lower rigid section 21 is affixed to base 24 on marine bottom 23 and extends upwardly to a point just below turbulent zone 25, which is that zone of water below the surface which is normally affected by surface conditions, e.g. currents, surface winds, waves, etc. Buoy section 26 is positioned at the top of rigid section 21 to maintain rigid section 21 in a vertical position under tension.

As will be explained in more detail below, flexible section 22 has a plurality of flexible conduits which are operatively connected to respective flow passages in rigid section 21 at buoy section 26. Flexible section 22 extends downwardly from buoy section 26 through a catenary path before extending upwardly to the surface, where it is connected to a floating facility 22*a*. With the overall compliant riser system having been generally described above, a description of major components and sub-systems will be set forth below.

LOWER RIGID SECTION

As shown in FIG. 1, base portion 24 and the lower portion of rigid section 21 are typical marine riser components. Base 24 is positioned on the marine bottom and submerged flowlines may be completed thereto. Base 24 may be a multi-well completion template, a submerged manifold center, or a like subsea structure. Each submerged flowline terminates on base 24 and preferably has a remote connector, e.g. "stab-in" connector, attached to lower end thereof. As illustrated in FIGS. 1 to 6, rigid section 21 may be constructed with a casing 27, which has a connector assembly (not shown) on its lower end which in turn is adapted to mate with mounting means on base 24 to secure casing 27 to base 24.

Figure 2:
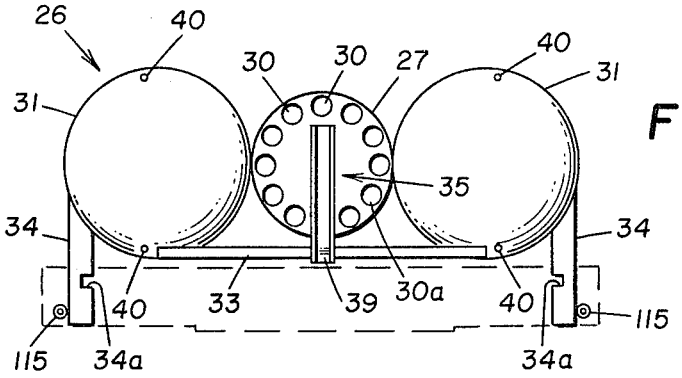
FIG. 2 is a plan view of the buoy portion; with a top connection portion removed.

As shown in FIG. 2, a plurality of individual rigid flowlines or conduits 30, which may be of the same or diverse diameters, are run through guides within or externally attached to casing 27 in a known manner. These are attached via stab-in or screw in connectors of the submerged flowlines on base 24, providing individual flowpaths from marine bottom 23 to a point adjacent the buoy means at the top of casing 27.

RISER BUOY SECTION SUBSYSTEM

Figure 3:
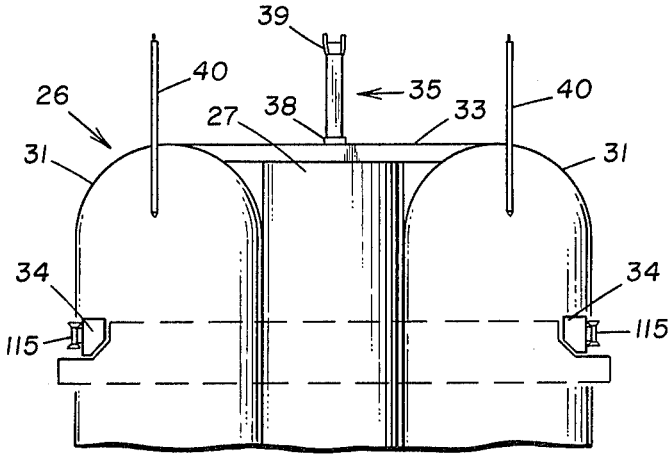
FIG. 3 is a side elevation view of the buoy portion.

Located at the top of casing 27 is buoy section 26 which is comprised of two buoyant chambers 31, affixed diametrically opposed to either side of casing 27. As shown in FIGS. 2 and 3, beam 33 extends between chambers 31 near their upper ends and is attached thereto. Yoke-receiving means 34 are attached to the outboard edges of chambers 31 and extend horizontally outward therefrom.

Figure 5:
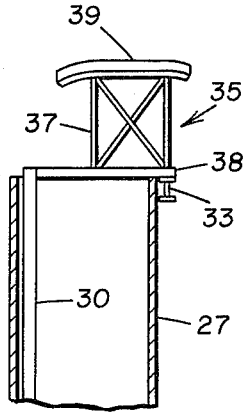
FIG. 5 is a vertical cross-section view of a buoy showing a typical support structure for a connection assembly.

Mounted atop casing 27 and affixed to beam 33 on the buoy means are plurality of support structures 35 for retaining inverted U-shaped connectors, as explained below. Although, for the sake of clarity, only one such support structure 35 is shown in FIGS. 2, 3, and 5 of the drawings, it should be understood that the overall support means includes a similar support structure 35 for each rigid conduit 30 within casing 27. The connector support means may include individual or integrateddesign frames. Though not shown, the individual support structures 35 will be positioned individually beneath each of the U-shaped connection assemblies 36, as shown assembled in FIG. 4.

Referring to FIG. 5, a typical support structure 35 is comprised of a vertical frame 37 having a lower mounting element 38 affixed to buoy beam 33 and having a trough 39 secured along its upper surface. Trough 39 is sufficiently large to receive a corresponding U-shaped or "gooseneck" conduit 36.

Figure 4:
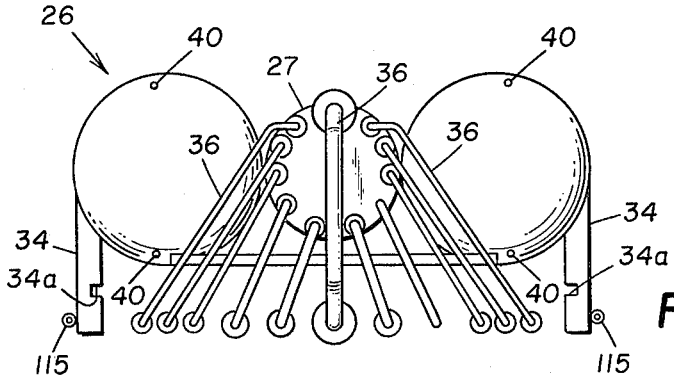
FIG. 4 is a plan view of the buoy section with a connection assembly attached.

In order to enhance stability of the support structures 35, additional bracing can be provided for support 35. It may be desirable to enclose support structure frame 37 with a fairing to minimize engaging by lines or tools, for instance, by welding a steel plate between the support structures 35 at trough 39 and by fairing in the sides of the open frame 37. Numerous variations in the gooseneck support means 35 can be designed within the inventive concept. Guide posts 40 are attached to buoyant chambers 31 and extend upward therefrom as shown in FIGS. 2, 3 and 4.

RISER BUOY CONNECTION SUBSYSTEM

Referring now to FIGS. 6 and 7, the details of the connection assembly sub-system and gooseneck conduits 36 will now be set forth. Gooseneck conduit 36 is comprised of a length of rigid conduit 41, which is curved downward at both ends to provide an inverted U-shaped flow path. Connector means 42 (e.g. hydraulically-actuated collet connector) is attached to one end of conduit 41 and is adapted to couple conduit 41 fluidly to its respective rigid conduit 30 when gooseneck 36 is lowered into an operable position. The extreme environmental conditions of subsea handling systems may cause frequent equipment failures and repair problems. In order to minimize pollution and loss of product, fail-safe valves are usually employed for all flowlines. Redundant connectors and hydraulic operators are also desirable because of occasional equipment failures. Emergency shut-off valve means is provided in conduit 41 just above its male end 45 as shown in FIG. 6. Preferably, valve means 43 is of the failsafe pressure-opened and spring-closed type valve well known in the art (e.g. Grove ball valve with Bettis actuator controls 44). Preferably, valve means 43 will not serve as the primary production shut-in means for its respective flow conduit (said primary means being normally located on the marine bottom 23 as understood in the art) but will be actuated only in an emergency or maintainence operation involving flexible section 22.

There is an individually-designed gooseneck conduit 36 for each rigid conduit 30. Welded or otherwise secured to a horizontal portion of the upper surface of gooseneck conduit 36 is a partial sleeve 32 which has one or more fishing necks 38 thereon. As shown in FIG. 6, two pairs of self-latching clamp means 46 are carried by sleeve 32. Each self-latching clamp means 46 is comprised of a latching member 47 pivotally mounted on support **32*a* on sleeve 32 and having a camming surface 47*a* on its lower end and ear 47*b* as its upper end. Spring 48 normally biases latch member 47 to a locked position. Hydraulic stabbing pod 49 is affixed to gooseneck conduit 36 and hydraulic lines extend from stab-in valves (not shown) within pod 49 to connector 42** for operatively connecting the gooseneck.

Running tool 50 includes a frame 51 having guide funnels 52 (see FIG. 8) at each corner thereof which are adapted to cooperate with guide posts 40 on buoyant chambers 31 so that running tool 50 may be lowered on guidelines into a proper alignment on buoy section 26. A hydraulically-released overshot 53 is provided on frame 51 for each fishing neck 38 on sleeve 32. Hydraulic cylinders 54 are positioned on either side of overshot 53 where rods 55 are adapted to engage latching ears **46*b* of latch elements 47 to move the ears to an unlocked position when rods 55 are extended from cylinders 54**.

Figure 8:
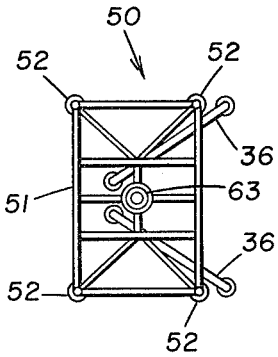
FIG. 8 is a plan view of a running tool guide means for installing the system.

Main hydraulic junction box 56 is positioned on frame 51 and has lines (shown in dashed lines in FIG. 6) running therefrom to various hydraulic control mechanisms on frame 51. Stab-in member 57 is carried by frame 51 and is adapted to cooperate with pod 49 to establish a hydraulic fluid path to connector 42. Hydraulic test junction box 58 is located on frame 51 and has a pressure test line 59 and a hydraulic release line 60 extending therefrom to a collet test connector 61 positioned on male end 45 of gooseneck conduit 41, the operation of which will be set forth below. Tether line 62 is connected between frame 51 and connector 61. Attachment means 63 is provided for connecting frame 51 to a drill string 64 or other lowering means for lowering and raising running tool 50. As illustrated in FIG. 8, in some instances, more than one gooseneck connection assembly can be run into position at the same time.

FLEXIBLE FLOWLINE SECTION SUBSYSTEM

Figure 10:
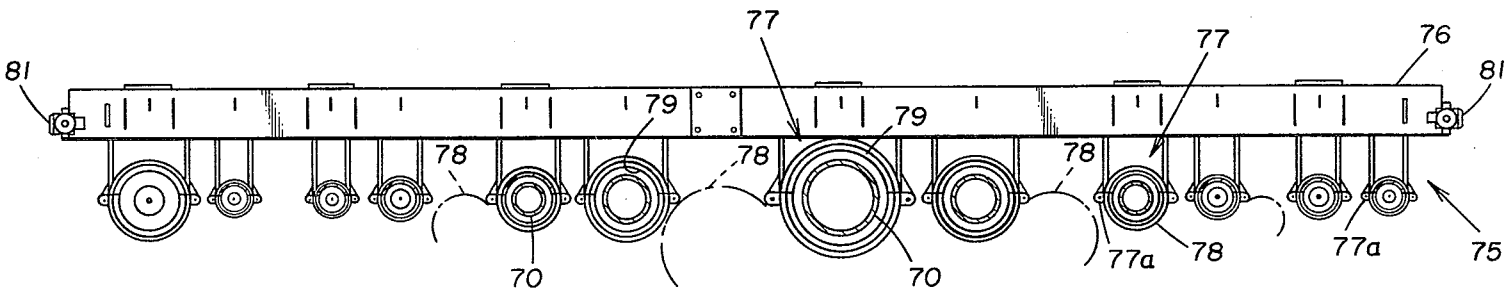
FIG. 10 is a cross-section view of the flexible conduit section showing a spreader beam.
Figure 9:
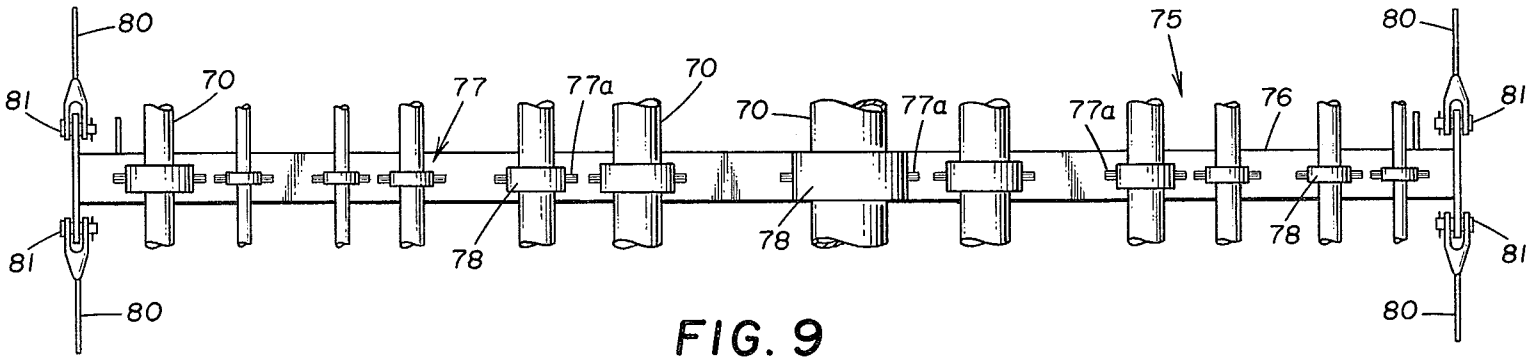
FIG. 9 is a side elevation view of the flexible section and spreader beam.

The compliant conduit section 22 (shown in FIG. 1) comprises a plurality of flexible catenary flowlines 70, each adapted to be operatively connected between the surface facility and its respective gooseneck conduit 36 on buoy section 26. The upper end of each flexible flow conduit 70 is attached at 71 to floating facility **22*a* by any suitable means. The preferred flexible flowlines are Coflexip multi-layered sheathed conduits. These are round conduits having a protective outer cover of "Rilsan" material. The flowlines are commercially available in a variety of sizes and may be provided with releasable ends. The ribbon-type flowline bundle restrains the flexible conduits from intercontact and provides sufficient clearance at the spreader beam guldes to permit unhindered longitudinal movement. Flexible conduits 70 are retained in parallel alignment or "ribbon" relationship substantially throughout their entire length. Multiple conduits of equal length can be held in this parallel relationship by a plurality of transverse spreader beams 75 (FIGS. 9 and 10) longitudinally spaced along flexible conduits 70 (four shown in FIG. 1**).

Spreader beam 75 is a transverse bar 76 on which a plurality of spaced guides 77 are provided; one guide for loosely retaining each flexible conduit 70. Each guide 77 has a hinged gate 78 which can be opened (see dotted lines in FIG. 10) to allow the respective conduit 70 to be positioned in guide 77 and then closed and locked by pin **77*a* to secure conduit 70 therein. Each guide is sufficiently large to provide a clearance around its respective flexible conduit (e.g. about 25% or more). To minimize scuffing of the flexible conduit 70, guides 77 may be lined with a plastic sleeve 79** having a low friction coefficient.

Since spreader beams 75 are slidable relative to flexible conduits 70, pendant support means are provided. Support rods or wires 80 are connected to each beam 75 by clamping or attachment means 81 to maintain beams 75 in predetermined longitudinal position. The upper ends of support elements 80 are connected to attachment means 71 on floating surface facility 22a so that spreader beams 75 are supported by wires.

YOKE ASSEMBLY AND CONNECTOR SUBSYSTEM

Figures 11, 12:
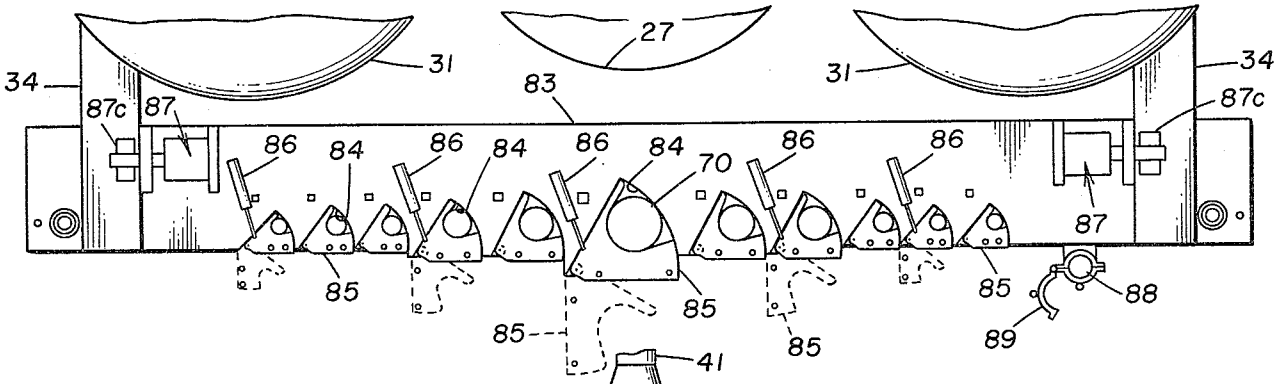
FIG. 11 is a detailed plan view of a yoke assembly for connecting the flexible section to the buoy section.
FIG. 12 is an elevation view of the yoke assembly showing the connecting means for establishing fluid communication between the flexible section and connection assembly.

Yoke assembly 82 (FIGS. 11 and 12) provides means for connecting flexible conduit section 22 to buoy section 26. Yoke assembly 82 includes an elongated horizontal support member 83. This member may be a box beam having a plurality of recesses 84 therein. Individual recesses 84 receive corresponding flexible flowlines 70 in linear array at horizontally spaced locations. Locking means, such as gate 85 pivotally mounted at recess 84, secures the end of flowline 70 to the yoke. Hydraulic cylinder 86 actuates gate 85 laterally between an open position (dotted lines in FIG. 11) and a closed locking position. Hydraulic cylinders 86 may be permanently attached on yoke support 83 or releasably mounted to be installed by a diver when needed.

Hydraulically-actuated connecting pin assemblies 87 are mounted at opposing ends of support element 83 and are adapted to lock the horizontal yoke support 83 to yoke arms 34 when yoke assembly 82 is in position at buoy section 26. The yoke assembly 82 is attached to the support arms 34 of the buoy section by having a pair of hydraulically-actuated connecting pin assemblies 87 located at ends of the yoke beam 83. This retractable attachment means has opposing retractable members 87c adapted to be retained adjacent arm slots 34a. A D-shaped bar configuration and mating arrangement between the yoke beam ends and support arm 34 permits the entire yoke assembly to fall away from the buoy section, thereby preventing angular distortion and damage to the flexible bundle in the event of attachment means failure or single retraction. Hydraulic line 88 for actuating the various mechanisms on yoke assembly 82 is attached by means of manual gate 89.

Mounted on the end of each flexible conduit 70 is a primary connector 90 (e.g. hydraulically-actuated Cameron collet connector) adapted to connect flexible conduit 70 remotely to male end 45 of a corresponding gooseneck conduit 41. To assure release of the flexible conduit from buoy section 26 in an emergency situation, a back-up or secondary fluid connector 91 may be installed adjacent primary connector 90.

Figure 14:
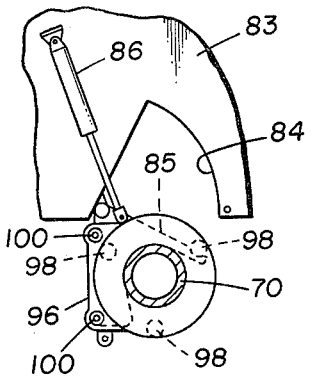
FIG. 14 is a plan view of a yoke recess portion showing installation of a flexible flowline prior to locking.
Figure 16:
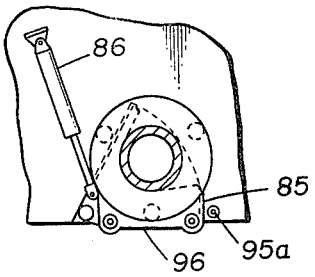
FIG. 16 is a plan view as in FIG. 14, showing the locking means after flowline installation.
Figure 13:
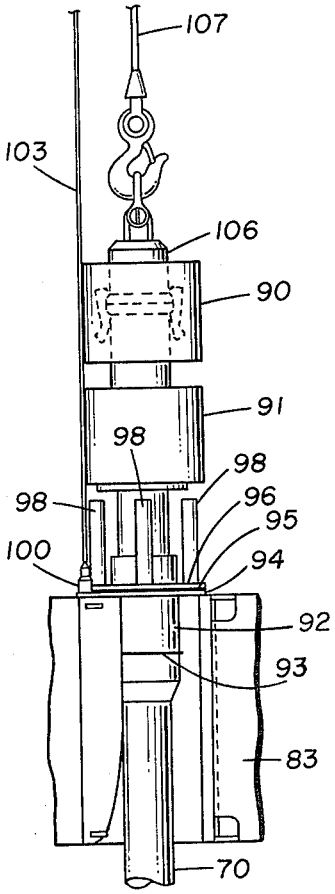
FIG. 13 is a side view of a portion of the yoke assembly with a flexible flowline being installed at a yoke recess with a lowering line.
Figure 15:
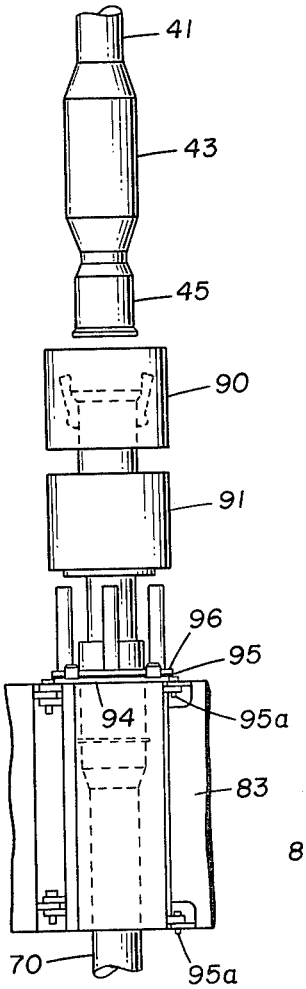
FIG. 15 is a side view similar to FIG. 13 after locking, showing alignment of the male gooseneck connector portion.
Figure 17:
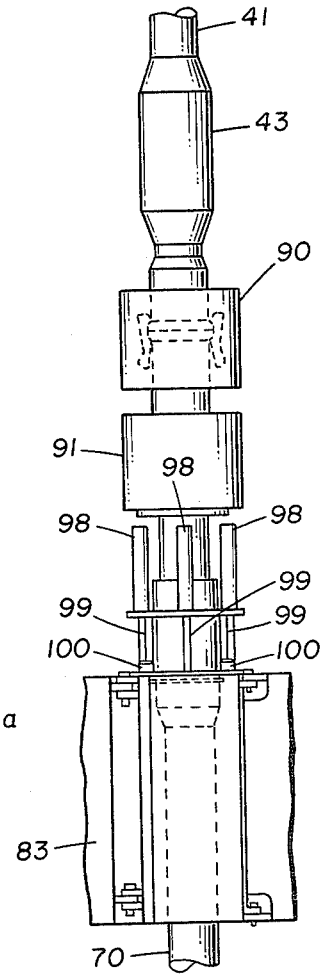
FIG. 17 is a side view as in FIG. 15, showing actuation of the jack assembly for connecting a flexible conduit to a connection assembly.

As shown in FIG. 13, located below secondary connector 91 is coupling 92 which has a lip 93 thereon. Rotating metal plate 94 and "Delrin" plastic plate 95 are rotatably and slidably mounted on coupling 92, resting on lip 93 until flexible conduit 70 is positioned in yoke 82. Bearing plate 96 is secured to coupling 92 and carries jack means comprising three equally-spaced hydraulically-actuated cylinders 98 which have pistons 99 adapted to extend downwardly against bearing plate 96. Coupling 92 is secured to gate 85 by rotating metal plate 94, which locks alignment pins 100 (See FIG. 14). With all of the major components having now been described, the method of installing the compliant riser system will follow.

INSTALLATION AND OPERATION

To install the compliant riser system 20 of the present invention, lower rigid section 27 with buoy section 26 in place is installed on base 24. Rigid conduits 30 are run into casing 27 and coupled to submerged flowlines on base 24. U.S. Pat. No. 4,182,584 illustrates a technique which can be used to install rigid section 27 and rigid conduits 30. The buoy means including chambers 31, beam 33, gooseneck support structures 35, and lateral yoke receiving arms 34 may be attached to casing 27 and installed simultaneously. Any protective caps used during installation or debris are removed from the upper ends of each rigid conduit 30 by divers. A gooseneck-type connection assembly is lowered on running tool 50 into its respective trough 39 on buoy section 26. Gooseneck conduit 36 is positioned on frame 51 of tool 50 so that it will be properly aligned with its respective trough and rigid conduit 30 when funnels 52 on frame 51 engage guide posts 40 on chambers 31 after being lowered along guidelines attached to posts 40. As gooseneck conduit 36 is moved downward into trough 39, the camming surfaces 47a of latch members 47 engages flange 39a (FIG. 7) on trough 39 to move members 47 outward until they snap under flange 39a, thereby locking gooseneck conduit 36 to trough 39. At the same time, connector 42 moves onto the upper end of conduit 30 and a means for actuating connector 42 is provided by hydraulic connection from the surface via pod 49.

After connector 42 is actuated, gooseneck conduit 36 and connector 42 are pressure tested by opening ball valve 43 either manually by a diver or via hydraulic line 43a (FIG. 6) and then supplying hydraulic pressure through line 59. After testing is completed, test connector 61 is then released via line 60 from male end 45 and is tethered to tool 50 via line 62 for removal with tool 50. Fishing necks 38 on sleeve 32 are released from overshots 53 on tool 50 and tool 50 is retrieved for reuse in positioning additional goosenecks 36. As shown in FIG. 8, more than one gooseneck 36 can be installed in one operation.

If electricity and/or hydraulics are needed to operator control or instrumentation on marine bottom 23, one or more bundles of control elements (e.g. 30a in FIG. 2A) can be provided within casing 27 and extended over a support frame 37 so that its upper end (FIG. 12) terminates approximately at the same position as do gooseneck conduits 36. When all gooseneck conduits 36 are in an operable position on buoy section 26, upper flexible section 22 is installed as follows.

Referring to FIGS. 19A–19D; one technique for assembling and installing flexible section 22 is disclosed. Flexible conduits 70 and electrical cable 70a (FIG. 12) are stored on powered reels (not shown) on vessel 22a. One end of each flexible conduit 70 and electrical cable 70a is connected to a plug 101 which is lowered upside down through moonpool A of vessel 22a. By means of line 102, plug 101 can be keelhauled between moonpool A and moonpool B. Alternatively, the moonpool plug or a portion thereof can be pre-installed, with the flexible lines being keelhauled individually and attached. Support wires 80 which support spreader beams 75 may be attached to plug 101 and are payed out with conduits 70. Spreader beams are assembled onto conduits 70 as they are payed out or each conduit 70 can be separately positioned in its respective guide 77 on beam 75 by a diver after each beam 75 enters in the water. After the plug 100 and/or flexible lines 70 are keelhauled toward moonpool B, yoke assembly 82 can be mounted on the ends of conduits 70 and electrical cables 70a as shown in FIGS. 19A–19D.

After flexible section 22 is assembled, rotary plug 101 is pulled into moonpool B of vessel 22a and affixed therein. Yoke 82 is lowered by means of lines 110 (FIGS. 12 and 12A–19D) to a position just below yoke support arms 34 on buoy section 26 (FIG. 19B). Diver D exits diving bell 111 and attaches taglines 112 to guidelines 113. By means of winch 114 on buoy section 26 and taglines 112, diver D pulls guidelines 113 into guide shoes 115 (FIGS. 11 and 12) which are split or hinged to allow lines 113 to enter. Slack is then taken up on lines 113 to draw yoke 82 into position on yoke support arms 14. As yoke 82 is drawn upward, upper support 87*a* of connecting pin assembly 87 (FIGS. 11 and 12) passes through slots 34*a* on support arms 34 (FIGS. 2 and 4). Hydraulic cylinders 87*b* are then actuated to move crossbar 87*c* into engagement between upper support arms 34 thereby locking yoke 82 in position on buoy section 26.

Cylinders 98 (FIGS. 13–17) are then actuated to move connector 90 into engagement with male end 45 of gooseneck conduit 36 and connector 90 is actuated to secure the connection between gooseneck conduit 36 and flexible conduit 70. Diver D then makes up the electrical/hydraulic connection between cables 41*a* and 70*a* to complete the installation.

Alternatively, the conduits can be assembled into yoke 82 after it has been positioned in the water. This procedure can be employed for initial installation or replacement of flexible flow lines individually.

Figure 18:
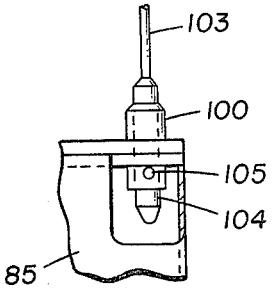
FIG. 18 is a partial detailed side view of a guidewire connection mechanism.
Figure 19D:
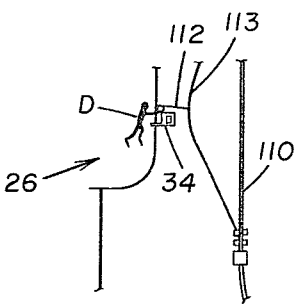
FIGS. 19A to D are a schematic representation of the installation sequence for the compliant riser system.
Figure 19C:
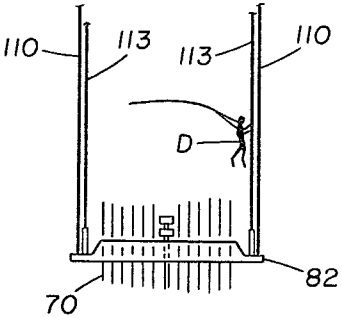
Figure 19B:
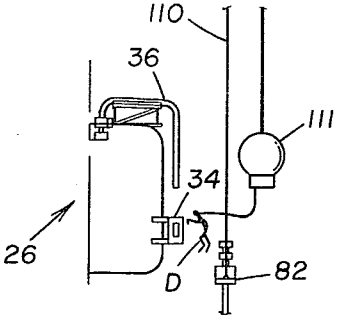
Figure 19A:
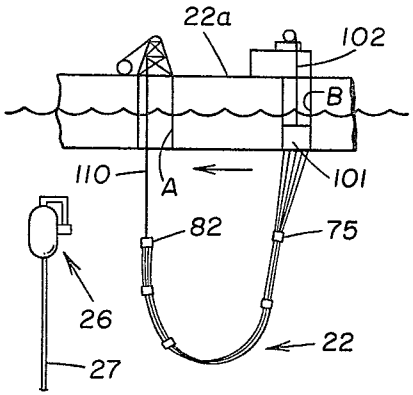

Referring to FIGS. 13–18, gate 85 on yoke 82 is moved to an open position (FIGS. 13 and 14) by hydraulic cylinder 86. Guidelines 103 are attached to loading gate 85 via plugs 104 which extend through hollow positioning pins 100 on gate 85 and are held in place by crosspins 105 (FIG. 18). Guidelines 103 cooperate with openings in rotating plate 94 to provide guidance for conduit 70 into gate 85. Nipple 106 (FIG. 13) is attached to connector 90 and lowering line 107 is attached to nipple 106.

Conduit 70 is lowered on guidelines 103 by line 107 onto gate 85, which supports the weight of the flexible flow line until connection is made. Openings in rotating plate 94 engage and receive positioning pins 100 on gate 85. Conduit 70 is then further lowered until bearing plate 96 comes to rest on "Delrin" plate 95. Cylinder 86 then closes gate 85 (FIGS. 15 and 16) and lock pins 95*a* are inserted by a diver to lock the gate closed. Guidelines 103 may then be removed from gate 85, and nipple 106 released from connector 90 to be retrieved with line 107.

If a conduit 70 needs repair or replacement, it can be individually replaced by disconnecting it from its respective gooseneck conduit 36 and opening its gate 85 on yoke 82. Lowering line 107 is then attached to connector 90 for retrieving the conduit 70. Spreader beam gates 77 are opened sequentially to remove the defective conduit 70. In very deep water use of divers may not be practical; however, the large clearances between spreader guides and round flexible flowlines may permit the hose and its terminal portion to be pulled through the spreaders from one end of the flowline bundle after disconnecting. A replacement conduit 70 may be assembled into flexible section 22 in a manner similar to initial installation procedure.

In an emergency situation, flexible section 22 can be quickly released from buoy section 26. Each conduit 70 is released from its respective gooseneck conduit 36 by releasing primary connector 90, or if connector 90 fails, by releasing secondary connector 91. Connecting crossbars 87*c* of assemblies 87 are retracted to allow yoke 82 to be released from support arms 34. Assemblies 87 are designed so that if only one bar 87*c* is retracted and the other assembly 87 fails, yoke 82 will fall away at the released end, thereby pulling the failed bar 87*c* as yoke 82 falls.

We claim:

1. In a marine compliant riser system wherein a catenary flexible flowline bundle is connected between a surface facility and a submerged lower riser section, the improvement which comprises:

said lower riser section including a vertical casing, and a plurality of rigid flowlines attached to said casing and extending from a marine floor base to a submerged buoy section located beneath the marine surface;

a yoke assembly mounted on the buoy section having means for supporting the flexible flowlines in a spaced linear array;

a plurality of inverted U-shaped rigid connection means each being connected at one end thereof to a respective one of said rigid flowlines, and the other end thereof extending downwardly above said yoke assembly in a linear array; and said flexible flowline bundle being connected at its upper end to said surface facility and extending downwardly in a catenary manner, each of said flexible flowlines extending upwardly through said support means of said yoke assembly and being connected to a respective one of said U-shaped rigid connection means;

whereby the terminal portion of each of said flexible flowlines is maintained in a substantial normal catenary departure angle with respect to a respective one of said U-shaped rigid connection means.

2. The riser system of claim 1 wherein each of said U-shaped connection means has at one end thereof hydraulically-actuated means for connection to a respective flexible flowline, and at the other end thereof hydraulically-actuated means for connection to a respective one of said rigid flowlines.

3. The riser system of claim 1 wherein the buoy section includes a plurality of rigid connector support structures mounted on the buoy section, each of said support structures having an upper trough for receiving a corresponding U-shaped connection means for supporting the U-shaped connection means during installation and fluid connection thereof.

* * * * *